US011206954B2

(12) United States Patent
Santiago Charriez

(10) Patent No.: US 11,206,954 B2
(45) Date of Patent: Dec. 28, 2021

(54) HANGING SHOWER BOTTLE HOLDER

(71) Applicant: Luis E. Santiago Charriez, Lorain, OH (US)

(72) Inventor: Luis E. Santiago Charriez, Lorain, OH (US)

( * ) Notice: Subject to any disclaimer, the term of this patent is extended or adjusted under 35 U.S.C. 154(b) by 0 days.

(21) Appl. No.: 16/994,455

(22) Filed: Aug. 14, 2020

(65) Prior Publication Data

US 2021/0045586 A1 Feb. 18, 2021

Related U.S. Application Data

(60) Provisional application No. 62/888,329, filed on Aug. 16, 2019.

(51) Int. Cl.

| | |
|---|---|
| ***A47K 3/28*** | (2006.01) |
| ***A47K 5/04*** | (2006.01) |
| ***A47F 7/28*** | (2006.01) |
| ***A47F 5/08*** | (2006.01) |
| ***A47B 45/00*** | (2006.01) |
| ***A47K 5/13*** | (2006.01) |

(52) U.S. Cl.

CPC ..... *A47K 3/281* (2013.01); *A47B 45/00* (2013.01); *A47F 5/08* (2013.01); *A47F 7/283* (2013.01); *A47K 5/04* (2013.01); *A47K 5/13* (2013.01); *A47K 2201/02* (2013.01)

(58) Field of Classification Search

CPC . A47K 3/281; A47K 5/04; A47K 3/00; A47K 3/001; A47K 3/02; A47K 2003/307; A47K 5/00; A47K 5/03; A47K 5/05; A47K 5/06; A47K 5/12; A47K 5/1207; A47K 5/1211; A47K 5/1212; A47K 5/1214; A47K 5/122; A47K 5/13; A47K 5/18; A47K 2201/02; A47K 2201/00; A47F 5/08; A47F 7/283; A47F 7/285; A47F 5/10; A47B 73/00; A47B 73/004; A47B 45/00; A47G 25/0614

USPC ..... 211/85.12, 119.009, 119.011, 119.004, 211/87.01, 75, 175; 248/309.3, 102, 103, 248/105–107, 311.2, 311.3, 312.1, 312

See application file for complete search history.

(56) References Cited

U.S. PATENT DOCUMENTS 1,029,390 A * 6/1912 Milewski ..... F16M 13/02 248/287.1
1,226,908 A * 5/1917 Peck et al. ..... A47K 10/04 211/119.011
1,624,695 A * 4/1927 Tufenkjian ..... A61J 9/0638 248/103

(Continued)

*Primary Examiner* — Jennifer E. Novosad

(74) *Attorney, Agent, or Firm* — McGlinchey Stafford; R. Andrew Patty II

(57) ABSTRACT

An apparatus which comprises two or more vertical members and a horizontal member attached to or integral with each of the vertical members. Each vertical member comprises (a) a lower arm comprising a support member and an attachment means for fixably attaching the arm to the vertical member; and (b) an upper arm comprising a retaining member, an attachment means for movably attaching the arm to the vertical member, and a vertical movement actuator. The lower arm and the upper arm are perpendicular or nearly perpendicular to the plane defined by the vertical members and the horizontal member, and wherein the lower arm and upper arm on each vertical member are in alignment to support the same container.

19 Claims, 6 Drawing Sheets

(56) References Cited

U.S. PATENT DOCUMENTS 2,180,042 A * 11/1939 Ettinger ..... B01L 3/0203 604/35
2,200,024 A * 5/1940 De Sipio ..... A47K 5/12 222/162
2,248,513 A * 7/1941 Riley ..... A47G 29/18 211/75
2,324,655 A * 7/1943 Tozer ..... B67C 11/00 248/94
2,463,664 A * 3/1949 Watson ..... B67D 3/0029 248/149
2,541,434 A * 2/1951 Nelson ..... E06C 7/14 248/210
2,603,441 A * 7/1952 Emmart ..... A47F 7/283 248/218.1
2,681,194 A * 6/1954 Halvorsen ..... A47G 1/1626 248/495
2,982,508 A * 5/1961 Larsen ..... E06B 1/6015 248/205.1
3,483,865 A * 12/1969 Arnell ..... A62B 7/02 128/205.22
3,627,244 A * 12/1971 Nicholas ..... A61J 9/0661 248/103
3,667,714 A * 6/1972 Ziaylek, Jr. ..... A62C 13/78 248/284.1
4,108,314 A * 8/1978 Racca ..... A47K 3/281 211/113
4,969,580 A * 11/1990 Mikhail ..... A47K 5/12 222/181.3
4,998,647 A * 3/1991 Sharp ..... A47K 5/1214 211/113
5,039,046 A * 8/1991 Brewster ..... F25D 25/022 248/206.3
5,060,393 A * 10/1991 Silverman ..... A61B 5/107 33/512
5,255,401 A * 10/1993 Sambrookes ..... A47K 3/281 206/77.1
5,871,192 A * 2/1999 Horwitz ..... B44C 5/02 248/309.1
5,924,659 A * 7/1999 Babcock ..... B01L 9/50 248/146
6,019,326 A * 2/2000 Baerwolf ..... F16M 11/045 248/177.1
6,398,174 B1 * 6/2002 Emalfarb ..... A47G 7/044 248/214
6,402,111 B1 * 6/2002 Stewart ..... A47B 21/0314 248/295.11
6,802,484 B1 * 10/2004 Kiley ..... A47G 23/0225 248/121
6,808,149 B1 * 10/2004 Sendowski ..... A47K 5/13 211/75
6,886,792 B2 * 5/2005 Immerman ..... F16B 47/00 211/106
7,588,225 B2 * 9/2009 Wawerski ..... B44D 3/14 16/425
9,549,611 B1 * 1/2017 Bocanegra ..... A47K 3/286
D790,249 S * 6/2017 Park ..... D6/540
D806,434 S * 1/2018 Yang ..... D6/525
9,883,742 B2 2/2018 Yang et al.
10,165,906 B1 * 1/2019 Beychok ..... A61L 9/013
D866,298 S * 11/2019 Kanter ..... D8/354
2008/0053935 A1 * 3/2008 Newbouild ..... A47B 96/1408 211/90.02
2016/0066751 A1 * 3/2016 Hinson ..... A47K 3/281 211/85.12
2021/0045586 A1 * 2/2021 Santiago Charriez ..... A47K 3/281

* cited by examiner

HANGING SHOWER BOTTLE HOLDER

REFERENCE TO RELATED APPLICATIONS

This application claims priority from U.S. Application No. 62/888,329, filed Aug. 16, 2019, the disclosure of which is incorporated herein by reference.

TECHNICAL FIELD

This invention relates to an apparatus for holding one or more bottles in a shower enclosure.

BACKGROUND

When storing bath product containers, typically bottles, in a shower or bathtub area, the containers tend to be scattered and stored on multiple flat surfaces available within the shower or bathtub area. The containers can fall and cause injury, for example to a person's toes and feet.

Another issue with bath product containers, particularly those containing liquids or gels, is that obtaining all of the product in each container can be difficult if the container is not stored with the opening at the bottom (upside-down, for most containers).

A suitable solution to both of these problems is desired.

SUMMARY OF THE INVENTION

This invention provides an apparatus which acts as a hanging bottle holder that holds bottles in a position for convenient dispensing. Advantageously, the apparatus according to the present invention permits containers to be held in place so that they do not fall, and so that it is convenient to obtain most or all of the product present in the container easily and without waste. In addition, the apparatus according to the invention provides an alternative to storing bath products such as shampoo and conditioner in a disorganized manner e.g., on bathtub shelves or other unconventional or inconvenient locations, provides a more convenient method of accessing the products in the container, particularly bathing products during a shower.

An embodiment of this invention is an apparatus which comprises two or more vertical members, a horizontal member, and each vertical member comprising a lower arm and an upper arm. The vertical members each comprise a lower end, an upper end, and an attachment means for attaching the apparatus to a vertical surface. The horizontal member is attached to or integral with each of the vertical members at or near the lower end of the vertical member. The lower arm comprises a support member defining an aperture sized and configured to receive an opening end of a container, and an attachment means for fixably attaching the lower arm to the vertical member. The upper arm comprises a retaining member sized and configured to receive a portion of a container, an attachment means for movably attaching the upper arm to the vertical member, and a vertical movement actuator capable of permitting vertical movement of the upper arm along at least a portion of the length of the vertical member. The lower arm and the upper arm are normally and preferably perpendicular or nearly perpendicular to the plane defined by the vertical members and the horizontal member, and the lower arm and upper arm on each vertical member are in alignment to support the same container.

Other embodiments of the invention include a method for assembling an apparatus, and a method for placing a container in the apparatus.

These and other embodiments and features of this invention will be still further apparent from the ensuing description and appended claims.

The Figures illustrate embodiments of specific aspects of the invention, and are not intended to impose limitations on the scope of the invention.

FURTHER DETAILED DESCRIPTION OF THE INVENTION

Throughout this document, the word "container" is used to refer to the items which the apparatus of the invention can hold; the word "bottle" is often used in the same manner, but should not be construed as limiting the application to bottles.

In an apparatus of the invention, the attachment means for attaching the apparatus to a vertical surface, typically a wall, can be a detachable attachment means, suitable non-limiting examples of which include hooks, suction cups, and the like, or more permanent attachment means, suitable non-limiting examples of which include adhesive, screws, nails, and the like.

Each vertical member comprises a lower arm and an upper arm. The lower arm and upper arm can each, independently, be attached to or integral with the vertical member. The upper arm is normally attached to rather than integral with the vertical member.

The vertical movement actuator for the upper arm preferably is capable of being operated without using a tool (i.e., is hand-operable by a human being). In some embodiments, the retaining member of the upper arm is adjustable to accommodate containers of various sizes, and preferably the adjusting is accomplished without the use of tools.

A preferred apparatus of the invention can be described as being comprised of a removable accessory holder (lower section) and an upper section having two sets of arms (a lower arm and an upper arm), securable to a vertical surface such as a shower wall by attachment means, e.g., suction cups. The upper arms are adjustable in height (along at least a portion of the length of the vertical member), and the upper arms in combination with the lower arm can be sized and configured to store and support different sizes of bottles.

In preferred embodiments, an accessory holder is present, and can be integral with, or preferably attached to, more preferably detachably attached to, the horizontal member, and is sized to hold one or more objects. The optional accessory holder, preferably sized and configured as a support platform for bars of soap, can be located at or below the level of the lower arms, preferably slightly below the lower arms (bottle support mechanisms).

The containers that are placed into the apparatus of the invention have an opening end which comprises the opening through which the product contained inside is dispensed, and an opposite end (the end opposite to the opening end).

In a method of the invention, a container is placed in the apparatus so that the opening end is in contact with the support member. Normally, the opening in the opening end of the container is placed in the aperture defined by the support member.

The invention will be further described with reference to the Figures.

Figure 1:
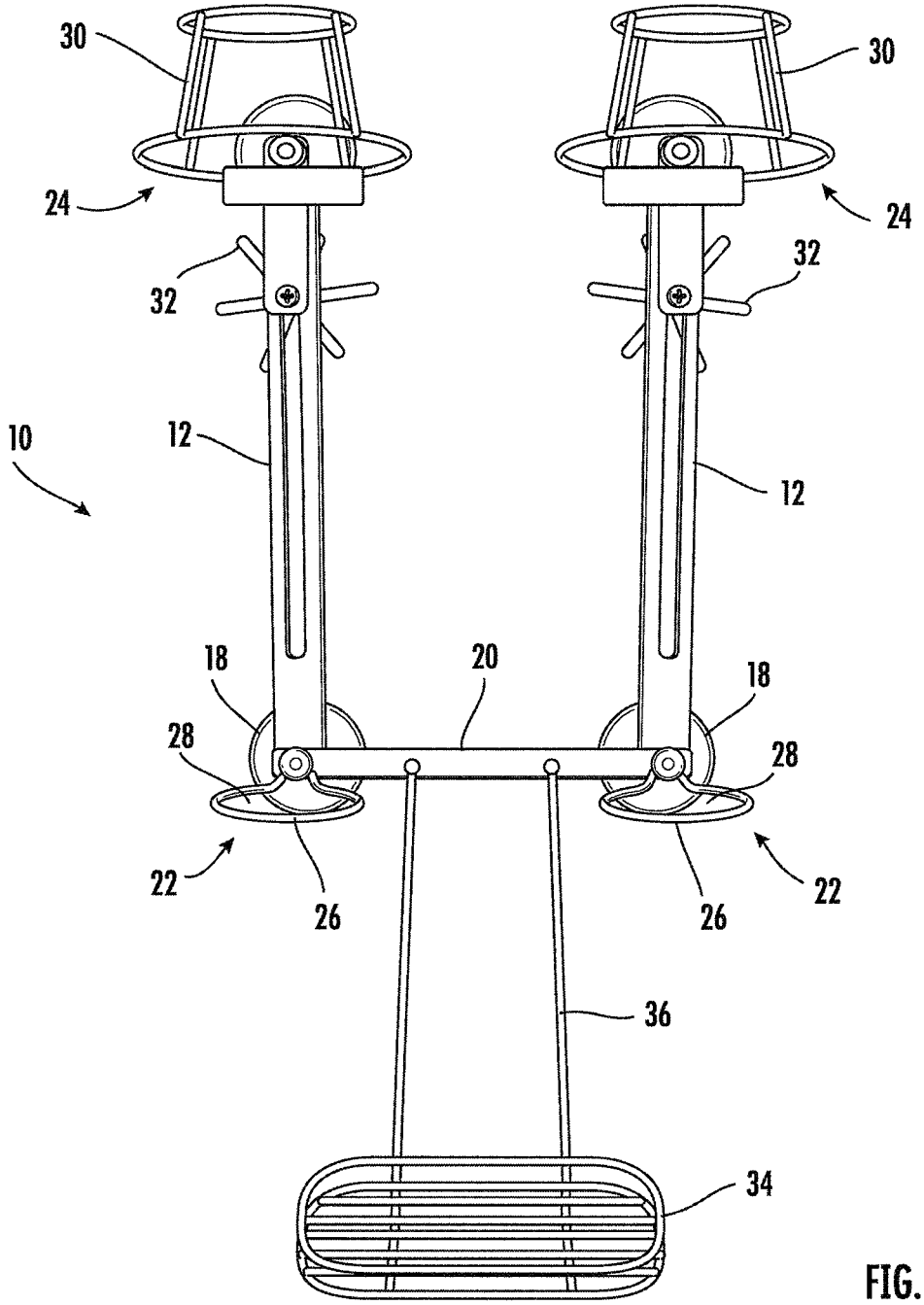
FIG. 1 is a front view of an apparatus of the invention with an optional accessory holder.

FIG. 1 shows an apparatus 10 of the invention, with vertical members 12, each vertical member 12 having a lower end 14 (not shown in FIG. 1) and an upper end 16 (not shown in FIG. 1), and attachment means 18 in the form of suction cups for attaching the apparatus 10 to a vertical surface. Horizontal member 20 is attached to the lower ends 14 of the vertical members 12. The lower arm 22 and the upper arm 24 are attached to vertical member 12. Also shown in FIG. 1 are the support member 26 of lower arm 22 defining an aperture 28 and the retaining member 30 and vertical movement actuator 32 of upper arm 24.

In FIG. 1, the plane defined by the vertical members and the horizontal member is in the plane of the paper; the lower arm and the upper arm are perpendicular or nearly perpendicular to the plane defined by the vertical members and the horizontal member; and the lower arm and upper arm on each vertical member are in alignment to support the same container.

FIG. 1 also shows an optional embodiment in which an accessory holder 34 is attached to the horizontal member 20 by accessory attachment means 36; in preferred embodiments, the accessory holder 34 (sometimes called a lower section) is sized and configured to hold (support) a specific object, especially a bar of soap. In some preferred embodiments, the accessory holder 34 is detachably attached to the horizontal member 20, for example by hooks; one purpose for detachable attachment of the accessory holder 34 is for the purpose of cleaning the accessory holder 32. The accessory holder 32 can be located at or below the level of the lower arm 22, and is preferably below the level of the lower arm 22.

Figure 2:
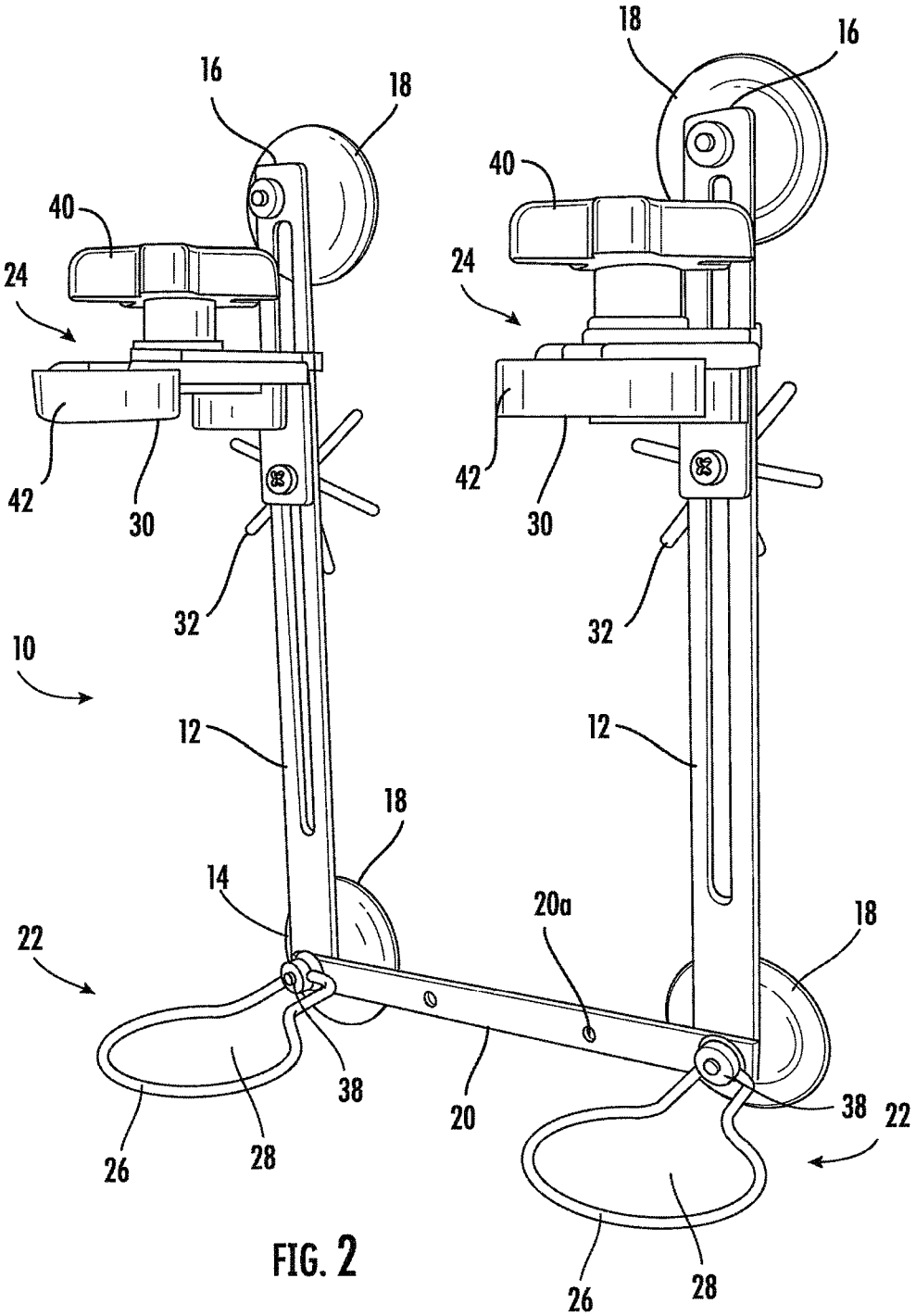
FIG. 2 is a side view of another apparatus of the invention.

FIG. 2 shows another embodiment of an apparatus 10 of the invention. Similar to FIG. 1, vertical members 12, the lower ends 14 upper ends 16, and the attachment means 18 (shown as suction cups) thereof, horizontal member 20, lower arm 22, upper arm 24, support member 26, retaining member 30, and vertical movement actuator 32 are shown in FIG. 2. Horizontal member 20 is attached to the lower ends 14 of the vertical members 12, and lower arm 22 and upper arm 24 are attached to vertical members 12. Shown in FIG. 2 are the support member 26 of lower arm 22 defining an aperture 28 as well as the retaining member 30 of upper arm 24 and vertical movement actuator 32 of upper arm 24. As shown in FIG. 2, the horizontal member 20 defines openings 20*a* to which one or more optional accessory holders 34 (not shown in FIG. 2) can be attached.

An attachment means 38 for fixably attaching the lower arm to the vertical member is seen in FIG. 2.

In FIG. 2, the retaining members 30 are size-adjustable by operating a knob 40 to permit a movable portion 42 of the retaining members 30 to be moved (adjusted) to the appropriate size for the container to be placed therein, so that the retaining members 30 permit adjustment to accommodate different sizes and types of containers.

Figure 3:
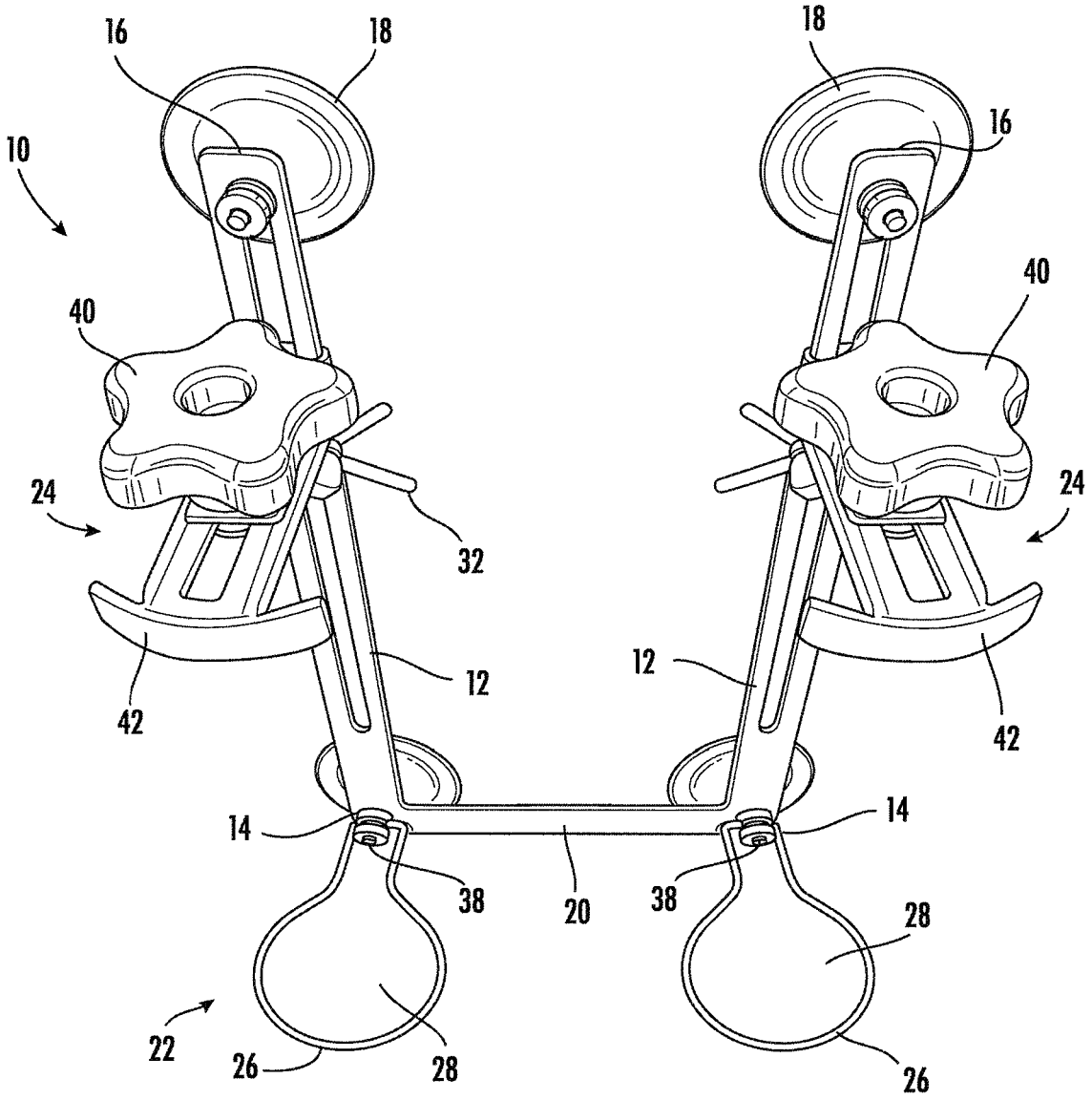
FIG. 3 is a view from the top of an apparatus of the invention.

FIG. 3 is a view from the top of an apparatus 10 of the invention as in FIG. 2, and shows the movable portions 42 of retaining members 30 in extended positions.

Figure 4:
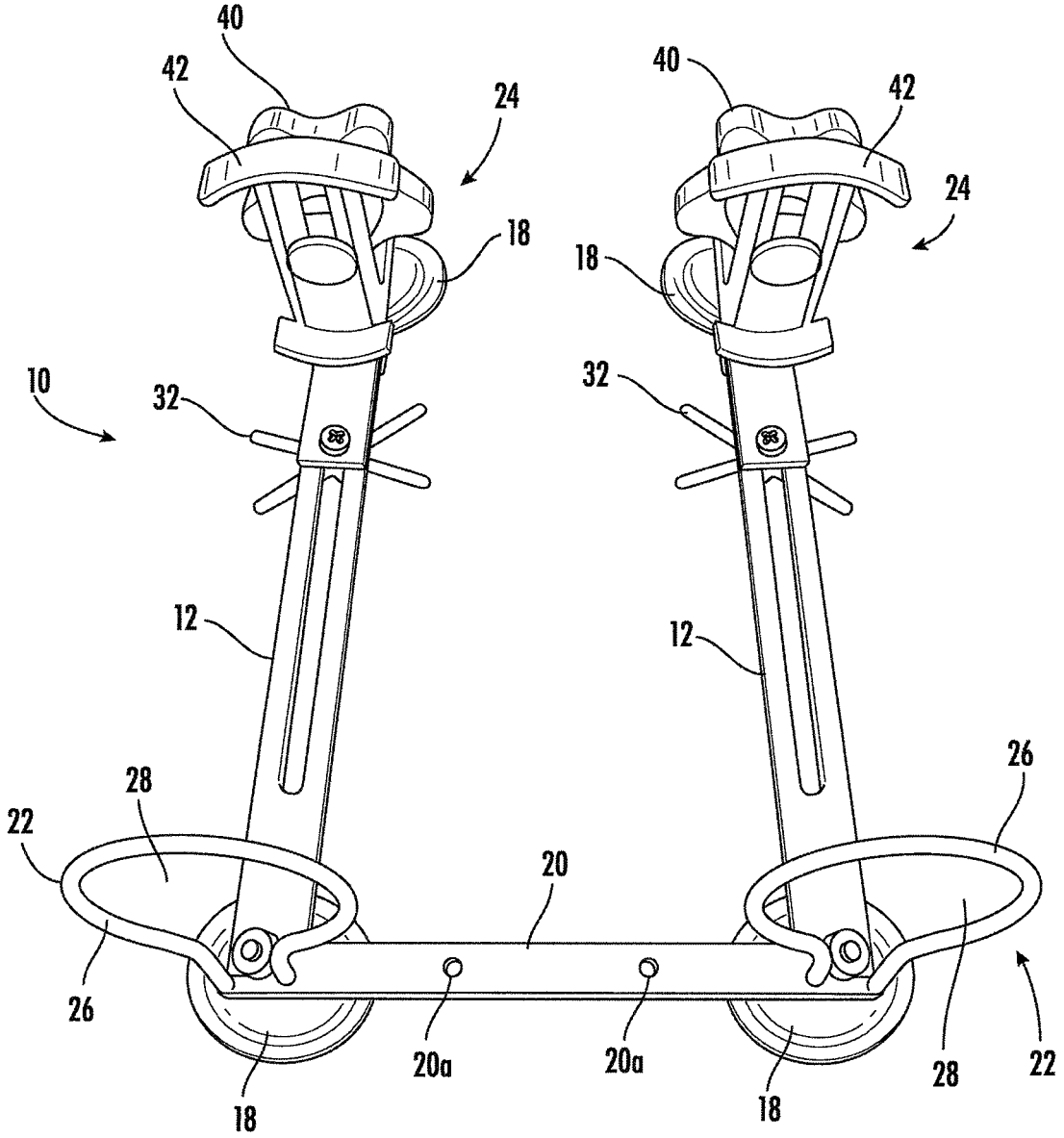
FIG. 4 is a view from the bottom of an apparatus of the invention.

FIG. 4 is a view from the bottom of an apparatus 10 of the invention as in FIG. 2, and shows the movable portion 42 of retaining members 30, with the movable portion 42 of one retaining member 30 in an extended position and the movable portion 42 of the other retaining member 30 in a non-extended position.

Figure 5:
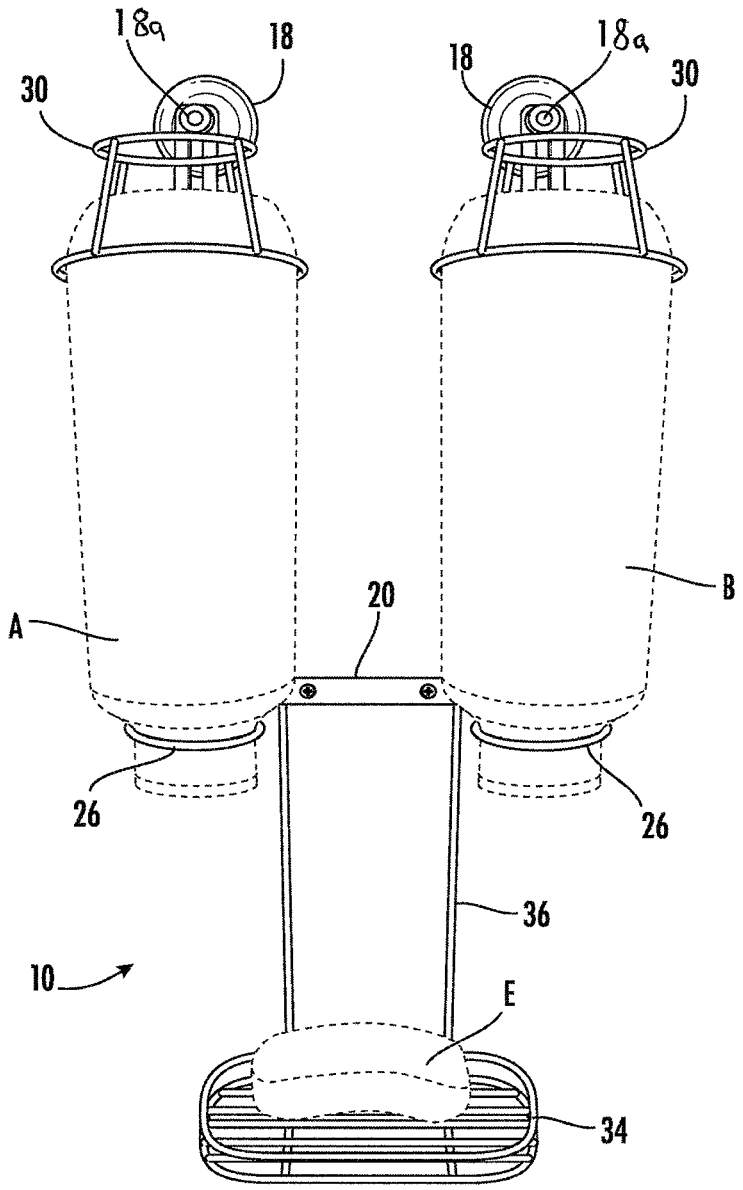
FIGS. 5 and 6 show the apparatus containing bottles.
Figure 6:
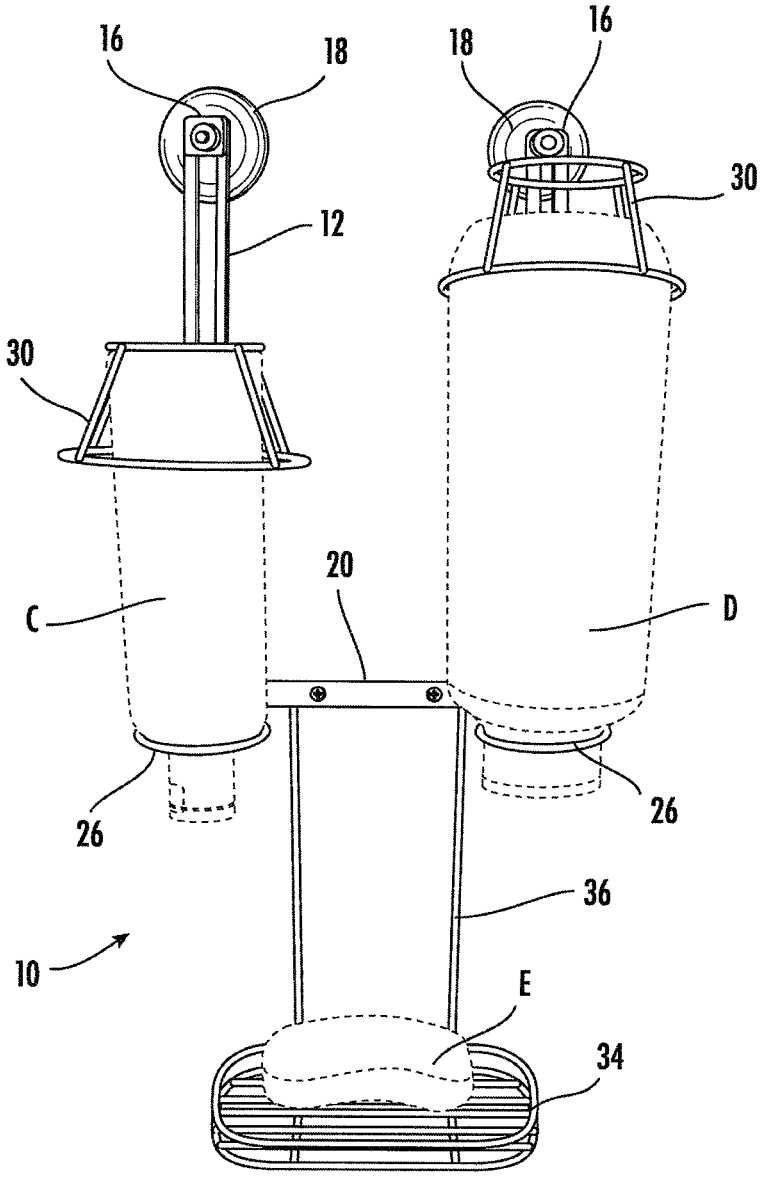

FIGS. 5 and 6 show an apparatus 10 of the invention as in FIG. 1 containing bottles in two different configurations, which demonstrate the adaptability of the apparatus 10 according to the invention. FIG. 5 also shows a portion 18*a* of attachment means 18 in the form of suction cups. In FIG. 5, the two bottles A and B are about the same size, while the two containers C and D in FIG. 6 are of different sizes, and the height of the retaining members 30 has been adjusted accordingly by use of the vertical movement actuator (not visible in FIGS. 5 and 6). The opening ends of the bottles are in contact with the support member 26, and the bottle openings are in the apertures 28 defined by the support members 26, and the opposite ends of the bottles are within the retaining members 30.

Also shown in FIGS. 5 and 6 is an optional accessory holder 34 attached to the horizontal member 20 by accessory attachment means 36, and the accessory holder 34 is shaped and configured to hold a bar of soap E.

A method for placing a container having an opening end comprising an opening and an opposite end into an apparatus of this invention is also provided. The method comprises:

placing the opening end of the container in contact with a support member; and adjusting the upper arm along at least a portion of the length of the same vertical member that is attached to the support member in which the opening end of the container was placed so that the opposite end of the container is received into the retaining member.

In a typical method of using the apparatus of the invention, bottles are placed in the apparatus, usually in an upside-down configuration (i.e., with the bottle opening in contact with the support member). In such a configuration, the bottle can easily dispense all of the product from the interior volume of the bottle. The bottles placed in the apparatus generally contain soap, shampoo, or conditioner. Once a bottle is in the apparatus, normally by placing the bottle in contact with the support member of the lower arm, the height of the upper arm is adjusted along at least a portion of the length of the vertical member as needed to hold the bottle in place by operating the vertical movement actuator, allowing for convenient dispensing of the product in the bottles. Usually, the opening of the bottle is in or through the aperture defined by the support member.

The invention may comprise, consist, or consist essentially of the materials and/or procedures recited herein.

As used herein, the term "about" modifying the quantity of an ingredient in the compositions of the invention or employed in the methods of the invention refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about", the claims include equivalents to the quantities.

Except as may be expressly otherwise indicated, the article "a" or "an" if and as used herein is not intended to limit, and should not be construed as limiting, the description or a claim to a single element to which the article refers.

Rather, the article "a" or "an" if and as used herein is intended to cover one or more such elements, unless the text expressly indicates otherwise.

This invention is susceptible to considerable variation in its practice. Therefore the foregoing description is not intended to limit, and should not be construed as limiting, the invention to the particular exemplifications presented hereinabove.

That which is claimed is:

1. A hanging shower bottle apparatus which comprises two or more vertical members, each vertical member comprising a lower end, an upper end, and an attachment means for attaching the apparatus to a vertical surface;

a horizontal member attached to or integral with each of the vertical members at or near the lower end of the vertical member;

wherein each vertical member comprises a lower arm comprising a support member defining an aperture sized and configured to receive an opening end of a container, and an attachment means for fixably attaching the arm to the vertical member; and an upper arm comprising a retaining member sized and configured to receive a portion of a container, the upper arm movably attached to the vertical member, and a vertical movement actuator capable of permitting vertical movement of the upper arm along at least a portion of the length of the vertical member;

wherein the lower arm and the upper arm are perpendicular or nearly perpendicular to the plane defined by the vertical members and the horizontal member, and wherein the lower arm and upper arm on each vertical member are in alignment to support the same container.

2. The hanging shower bottle apparatus as in claim 1 wherein the attachment means for attaching the apparatus to a vertical surface is a detachable attachment means.

3. The hanging shower bottle apparatus as in claim 1 wherein the retaining member of the upper arm is adjustable.

4. The hanging shower bottle apparatus as in claim 1 wherein the horizontal member defines at least one attachment means for attachment to an accessory holder.

5. The hanging shower bottle apparatus as in claim 1 wherein an accessory holder is attached or detachably attached to the horizontal member.

6. The hanging shower bottle apparatus as in claim 5 wherein the accessory holder is attached to or integral with the horizontal member.

7. The hanging shower bottle apparatus as in claim 5 wherein the accessory holder is:

detachably attached to the horizontal member; and/or sized and configured as a support platform for bars of soap.

8. A method for placing a container having an opening end comprising an opening and an opposite end into the apparatus of claim 1, which method comprises:

placing the opening end of the container in contact with the support member of the lower arm; and adjusting the position of the upper arm along at least a portion of the length of the same vertical member that is attached to the support member in which the opening end of the container was placed so that the opposite end of the container is received into the retaining member.

9. A method as in claim 8 wherein the retaining member is adjustable, the method further comprising adjusting the retaining member.

10. A method as in claim 8 further comprising attaching an accessory holder to the apparatus.

11. A method as in claim 8 further comprising attaching the accessory holder to the horizontal member.

12. A method as in claim 11 wherein the accessory holder is sized and configured as a support platform for bars of soap.

13. A method for assembling a hanging shower bottle apparatus, which method comprises attaching a horizontal member to two or more vertical members, each vertical member comprising a lower end, an upper end, and an attachment means for attaching the apparatus to a vertical surface, wherein the horizontal member is attached to each of the vertical members at or near the lower end of the vertical member;

attaching to each vertical member a lower arm comprising a support member defining an aperture sized and configured to receive an opening end of a container, and an attachment means for fixably attaching the arm to the vertical member; and an upper arm comprising a retaining member sized and configured to receive a portion of a container, the upper arm movably attached to the vertical member, and a vertical movement actuator capable of permitting vertical movement of the upper arm along at least a portion of the length of the vertical member;

wherein the lower arm and the upper arm are oriented perpendicular or nearly perpendicular to a plane defined by the vertical members and the horizontal member, and wherein the lower arm and upper arm on each vertical member are aligned to support the same container.

14. A method as in claim 13 wherein the attachment means for attaching the apparatus to a vertical surface is a detachable attachment means.

15. A method as in claim 13 wherein the retaining member of the upper arm is adjustable.

16. A method as in claim 13 wherein the horizontal member defines at least one attachment means for attachment to an accessory holder.

17. A method as in claim 13 further comprising attaching an accessory holder to the apparatus.

18. A method as in claim 17 further comprising attaching or detachably attaching the accessory holder to the horizontal member.

19. A method as in claim 17 wherein the accessory holder is detachably attached to the horizontal member; and/or sized and configured as a support platform for bars of soap.

* * * * *